US010012233B2

(12) United States Patent
Levasseur

(10) Patent No.: US 10,012,233 B2
(45) Date of Patent: Jul. 3, 2018

(54) VENTILATION SYSTEM

(71) Applicant: Valeo Systemes Thermiques, Le Mesnil Saint Denis (FR)

(72) Inventor: Antoine Levasseur, Montigny-le-Bretonneux (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 239 days.

(21) Appl. No.: 14/386,423

(22) PCT Filed: Mar. 22, 2013

(86) PCT No.: PCT/EP2013/056147

§ 371 (c)(1),
(2) Date: Jan. 9, 2015

(87) PCT Pub. No.: WO2013/139981

PCT Pub. Date: Sep. 26, 2013

(65) Prior Publication Data

US 2015/0125326 A1 May 7, 2015

(30) Foreign Application Priority Data

Mar. 22, 2012 (FR) ..... 12 52592

(51) Int. Cl.
*F04D 25/06* (2006.01)
*F04D 29/32* (2006.01)
*F04D 29/64* (2006.01)

(52) U.S. Cl.
CPC ..... *F04D 25/06* (2013.01); *F04D 25/0613* (2013.01); *F04D 29/329* (2013.01); *F04D 29/646* (2013.01)

(58) Field of Classification Search
CPC ..... F04D 25/0613; F04D 29/329
See application file for complete search history.

(56) References Cited

U.S. PATENT DOCUMENTS 5,944,497 A 8/1999 Kershaw et al.
6,129,528 A * 10/2000 Bradbury ..... F04D 29/384 416/223 R
6,368,081 B1 * 4/2002 Matsumoto ..... F04D 25/082 417/423.1

(Continued)

FOREIGN PATENT DOCUMENTS

DE 102009050369 A1 4/2011

OTHER PUBLICATIONS

English language abstract for DE 102009050369 extracted from espacenet.com database on Oct. 28, 2014, 2 pages Also see English equivalent US 2012/0224988.

(Continued)

*Primary Examiner* — Patrick Hamo
(74) *Attorney, Agent, or Firm* — Howard & Howard Attorneys PLLC

(57) ABSTRACT

A ventilation system includes a blower wheel (1) and a drive motor (9) with an external rotor (9*b*). The blower wheel (1) includes a central part (3) having a cylindrical wall (11) and defines a housing (13) to house the external rotor (9*b*). The blower wheel (1) further includes a frontal wall (15) comprising an opening (17) so as to exhibit a degree of openness that is greater than a predefined degree of openness.

8 Claims, 3 Drawing Sheets

(56) References Cited

Figure 1:
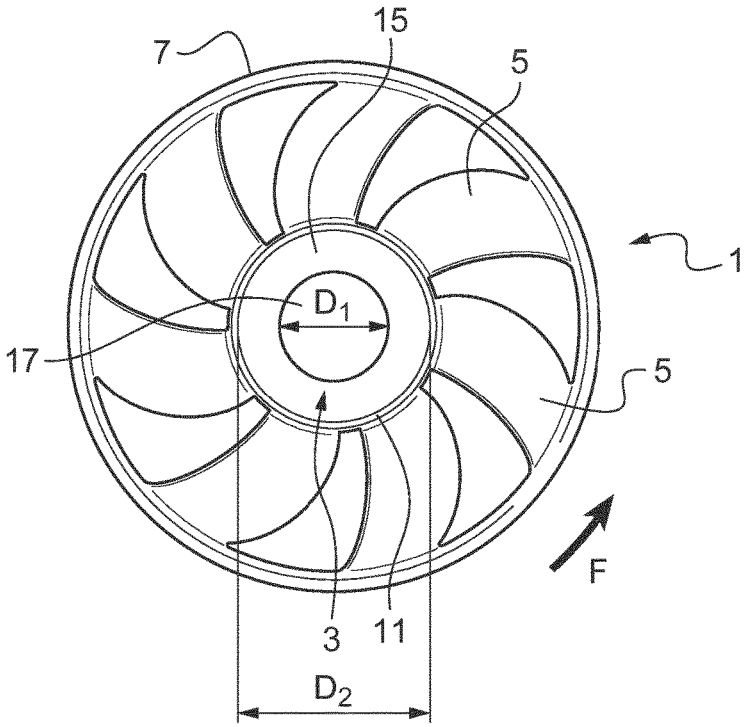

U.S. PATENT DOCUMENTS 7,699,582 B2 * 4/2010 Tao ..... H05K 7/20172 415/213.1
8,444,373 B2 * 5/2013 Tang ..... F04D 25/166 361/695
2003/0012646 A1 1/2003 Liao et al.
2004/0126232 A1 * 7/2004 Lin ..... F04D 25/0613 415/220
2009/0191055 A1 * 7/2009 Li ..... F04D 25/0613 415/220
2009/0196744 A1 * 8/2009 Yu ..... F04D 25/0613 415/177
2009/0290998 A1 * 11/2009 Tabata ..... F04D 25/0613 417/354
2010/0209264 A1 * 8/2010 Takemoto ..... F04D 29/541 417/366
2010/0215505 A1 8/2010 Takeshita
2011/0194955 A1 * 8/2011 Kudo ..... F04D 17/16 417/410.1
2012/0224988 A1 9/2012 Maier et al.
2012/0230815 A1 * 9/2012 Teramoto ..... F04D 25/0613 415/200
2015/0176587 A1 * 6/2015 Tamaoka ..... F04D 25/0613 417/354
2015/0198176 A1 * 7/2015 Tamaoka ..... F04D 29/5853 361/679.49
2015/0226225 A1 * 8/2015 Adachi ..... F04D 19/002 417/423.12

OTHER PUBLICATIONS

International Search Report for PCT/EP2013/056147 dated Aug. 6, 2013, 7 pages.

* cited by examiner

Fig.3
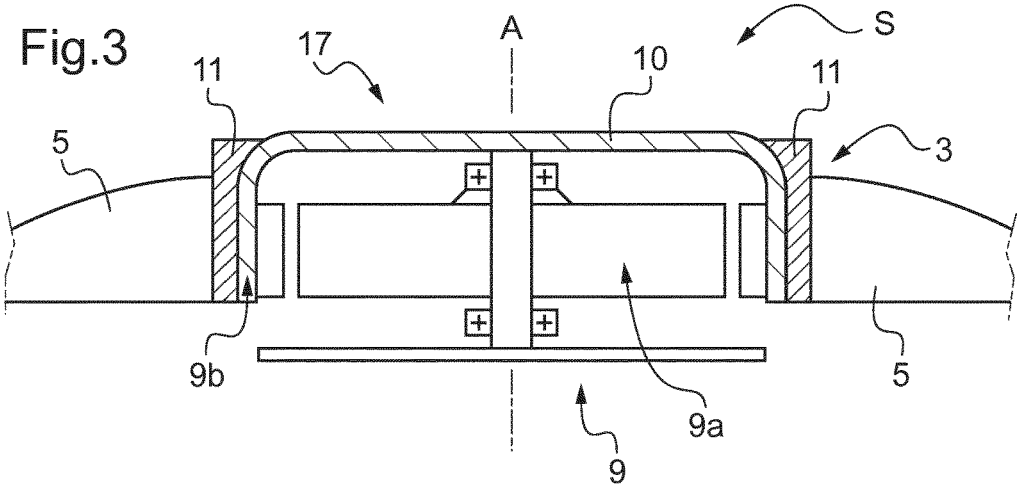
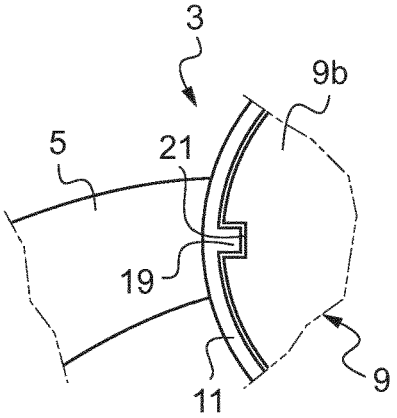
Fig.4a
Fig.4b
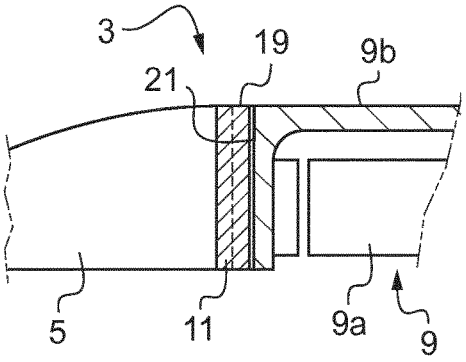
Fig.5a
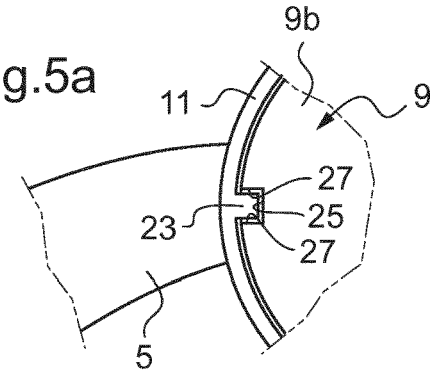
Fig.5b
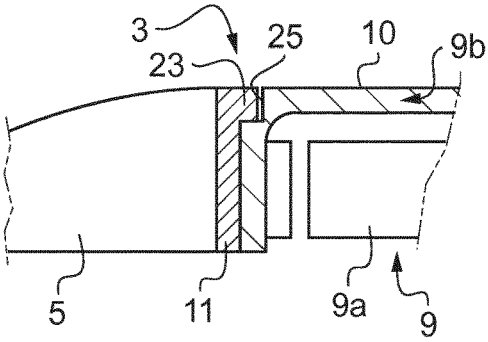

VENTILATION SYSTEM

RELATED APPLICATIONS

This application is the National Stage of International Patent Application No. PCT/EP2013/056147, filed on Mar. 22, 2013, which claims priority to and all the advantages of French Patent Application No. 12/52592, filed on Mar. 22, 2012, the content of which is incorporated herein by reference.

The invention relates to a ventilation system comprising a blower wheel and a motor with an external rotor.

The blower wheel comprises a central hub and blades extending radially from the hub toward the outside of the blower wheel.

Such a blower wheel is notably used for cooling the engine that drives the motor vehicle. In that sense, the blower wheel can be positioned upstream or downstream of a heat exchanger, namely a radiator that cools the drive engine.

In a known configuration, the blower wheel comprises a central hub generally with a frontal wall and a substantially cylindrical wall extending from the frontal wall and to which the blower wheel blades are connected.

The frontal wall has a substantially annular shape and can be used for example for attaching the electric motor that drives the rotation of the blower wheel.

This electric motor is generally mounted coaxially with the hub of the blower wheel.

The motor may have an internal rotor and an external stator and the hub is generally connected to the drive shaft of the motor.

When the motor has an external rotor in contact with the hub and an internal stator, attachment is also performed near the center of the frontal wall of the hub of the blower wheel.

It is therefore necessary to have a frontal wall so that the blower wheel can be attached to the motor.

However, that solution requires a significant quantity of material to define the housing for the motor in the hub.

It is an objective of the invention to alleviate these disadvantages of the prior art by proposing an improved blower wheel that makes it possible to reduce the amount of material while at the same time allowing attachment of the hub to the motor for driving the rotation of the blower wheel.

To that end, the subject of the invention is a ventilation system comprising a blower wheel and a drive motor with an external rotor, said blower wheel comprising a central part having a cylindrical wall and defining a housing to house said external rotor, characterized in that this further comprises a frontal wall comprising an opening so as to exhibit a degree of openness that is greater than a predefined degree of openness.

The ventilation system may further comprise one or more of the following features, considered separately or in combination:

- the predefined degree of openness is of the order of 85% to 90%;
- the opening is a circular central opening;
- the degree of openness is 100%, so that the central part is devoid of any frontal wall;
- the blower wheel comprises means of attaching said central part to said rotor;
- said attachment means are borne by the cylindrical wall and are configured to collaborate with complementary attachment means provided on said rotor;
- said attachment means comprise means of securing the central part to said rotor in terms of rotation;

- said means of securing in terms of rotation comprise at least one of the following means: a rib and complementary groove, and a notch and complementary projection;
- said attachment means comprise means of axially blocking the central part;
- said axial-blocking means comprise at least one of the following means: screwing means, and clipping means;
- the cylindrical wall has at least one radial projection configured to bear against a frontal wall of said rotor so as to define a screwing surface;
- the cylindrical wall bears at least one clipping means comprising an elastically deformable clipping tab and a protuberance able to come to bear against a frontal wall of said rotor.

The opening made in the frontal wall makes it possible to reduce the amount of material needed to define the housing for the motor.

It still remains possible to attach to the remaining part of the front wall; because the rotor is an external rotor there is no need to provide a fixing near the center of the frontal wall.

In addition, this opening may be total such that there is no longer any frontal wall; and where such is the case, because the rotor is an external rotor, the cylindrical wall can be attached directly to the rotor for driving the rotation of the blower wheel.

Figure 2:
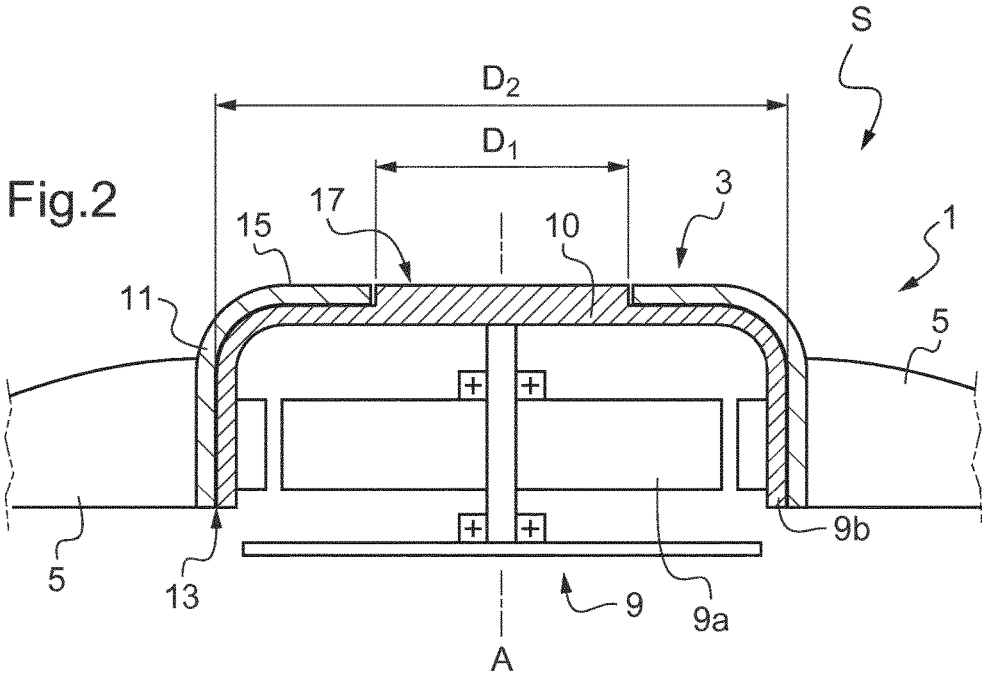
Figure 6B:
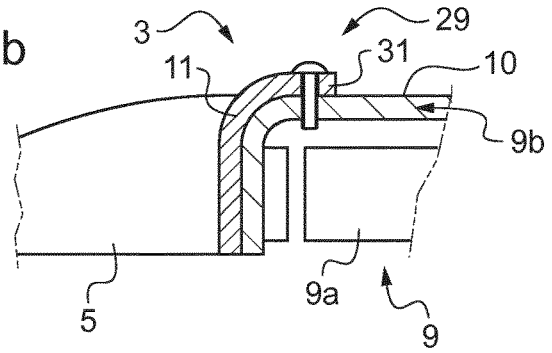
Figure 6A:
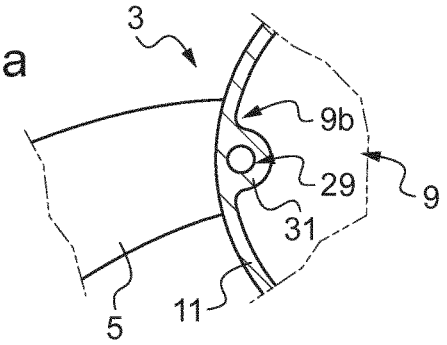
Figure 7A:
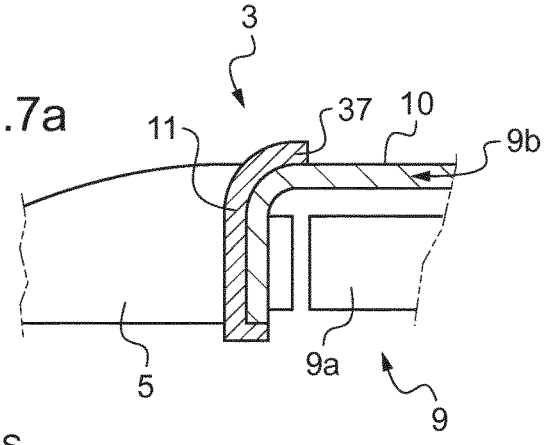
Figure 7B:
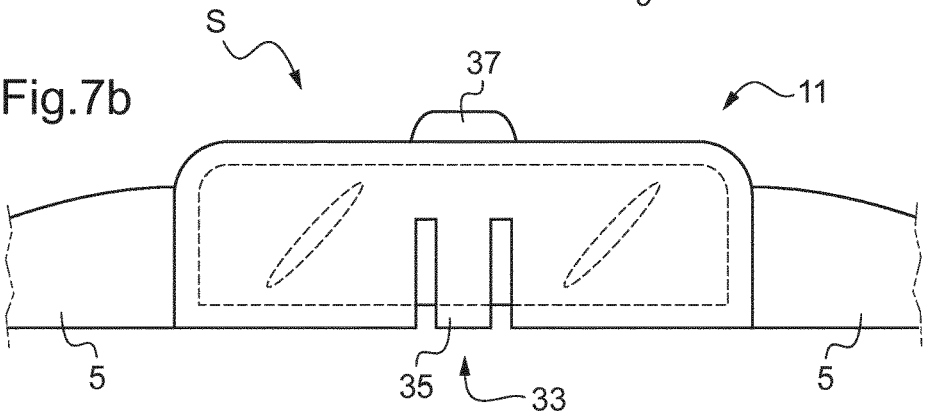

Further advantages and features of the invention will become more clearly apparent from reading the following description, given by way of illustrative and nonlimiting example, and from studying the attached drawings, among which:

FIG. 1 is a face-on view of a blower wheel of a ventilation system,

FIG. 2 is a view in cross section of the ventilation system of FIG. 1, comprising a blower wheel and a drive motor, FIG. 3 is a view in cross section of the ventilation system according to an embodiment alternative, FIG. 4*a* depicts a simplified view from above of part of the blower wheel comprising means for securing in terms of rotation to the rotor of the motor according to a first alternative form, FIG. 4*b* is a simplified view in cross section of the blower wheel of FIG. 4*a*, FIG. 5*a* depicts a simplified view from above of part of the blower wheel comprising means for securing in terms of rotation to the rotor of the motor according to a second alternative form, FIG. 5*b* is a simplified view in cross section of the blower wheel of FIG. 5*a*, FIG. 6*a* is a schematic view depicting part of the blower wheel comprising axial-blocking means according to a first alternative form, FIG. 6*b* is a simplified view in cross section of the blower wheel of FIG. 6*a*, FIG. 7*a* is a simplified view in cross section of part of a blower wheel comprising clipping means, and FIG. 7*b* is a side view of the blower wheel of FIG. 7*a*, depicting the clipping means.

In these figures, elements that are substantially identical bear the same references.

With reference to FIGS. 1 and 2, the invention relates to a ventilation system S comprising a blower wheel 1 and a drive motor 9.

The blower wheel 1 comprises a central part 3 otherwise referred to as a central hub, and a plurality of blades 5 which extend radially from the central part 3.

The blower wheel 1 may further comprise a peripheral shroud 7 to which the free ends of the blades 5 are connected.

This notably is a blower wheel 1 of a cooling module that cools a motor vehicle engine block (not depicted).

Such a cooling module generally comprises a heat exchanger such as a cooler. The blower wheel 1 may be arranged either in front of or behind this cooler.

The blower wheel 1 is mounted to rotate about the axis of rotation A (cf. FIG. 2). The direction of rotation of the blower wheel 1 is illustrated schematically by the arrow F in FIG. 1.

When the blower wheel 1 is driven in rotation, by the electric motor 9 visible in FIG. 2, the blower wheel 1 creates a flow of air from upstream to downstream by imparting its energy of rotation thereto.

Here, the terms "upstream" and "downstream" refer to the direction in which the stream of air flows.

The blower wheel 1 is, for example, produced in plastic by injection molding.

The central part 3 of the blower wheel 1 has a cylindrical wall 11 defining a housing 13 to house the drive motor 9. This motor 9 according to the embodiment described comprises an internal stator 9*a* and an external rotor 9*b* around the stator 9*a* exhibiting a frontal wall 10.

The central part 3 may additionally comprise a frontal wall 15 exhibiting an opening 17. The frontal wall 15 of the central part 3 rests against the frontal wall 10 of the rotor 9*b*.

The opening 17 in the frontal wall 15 of the central part 3 is dimensioned such that the frontal wall 15 has a degree of openness that is greater than a predefined degree of openness. The predefined degree is, for example, of the order of 85% to 90%.

According to the embodiment illustrated in FIGS. 1 and 2, the opening 17 is central.

This opening 17 is, for example, circular and has a first diameter $D_1$.

The frontal wall 15 has a second diameter $D_2$.

The degree of openness corresponds to the ratio of the first diameter $D_1$ of the opening 17 to the second diameter $D_2$ of the frontal wall 15. This degree of openness is greater than the predefined degree of openness, for example of the order of 85% to 90%.

Thus, the frontal wall 15 may have an opening 17 that exceeds the degree of openness, or may even have a degree of openness of 100%. In that case, the central part 3 is considered to be devoid of any frontal wall but has just a cylindrical wall 11 and an opening 17, as depicted schematically in FIG. 3.

Moreover, the blower wheel 1 comprises means of attaching the central part 3 to the rotor 9*b*.

According to the embodiments illustrated in FIGS. 4*a* to 7*b*, the means of attachment are borne by the cylindrical wall 11 of the central part 3 of the blower wheel 1, and are able to collaborate with complementary means of attachment provided on the rotor 9*b*.

The central part 3 needs to be able to be driven in rotation by the rotor 9*b*, and to achieve this, the means of attachment comprise means of securing in terms of rotation.

Securing in terms of rotation is obtained for example through complementary shapes of the central part 3 and of the rotor 9*b*, particularly of the cylindrical wall 11 and of the rotor 9*b*.

To that end, it is notably possible to provide a rib 19 and a groove 21 that complement one another, these being borne one of them by the central part 3 and the other by the rotor 9*b*.

According to the embodiment depicted in FIGS. 4*a*, 4*b*, the cylindrical wall 11 of the central part 3 has, on its face facing the rotor 9*b*, one or more ribs 19 respectively able to engage in a complementary groove 21 provided on the rotor 9*b*, more specifically on that surface of the rotor 9*b* that faces the cylindrical wall 11.

Of course, the reverse arrangement may also be anticipated. In other words, the cylindrical wall 11 of the central part 3 has, on its face facing the rotor 9*b*, one or more grooves respectively able to accommodate a complementary rib belonging to the rotor 9*b*, more specifically arranged on that surface of the rotor 9*b* that faces the cylindrical wall 11.

In addition or as an alternative, a projection 23 and a notch 25 that complement one another may be provided (cf. FIGS. 5*a*, 5*b*) for securing the central part 3 to the rotor 9*b* in terms of rotation.

According to the example illustrated in FIGS. 5*a*, 5*b*, the cylindrical wall 11 of the central part 3 has one or more projections 23 directed toward the rotor 9*b*, and the rotor 9*b* to complement this has one or more associated notches 25.

Thus, a projection 23 of the cylindrical wall 11 engages in an associated notch 25 belonging to the rotor 9*b* and is therefore enveloped by the lateral walls 27 that delimit this notch 25.

Of course, the reverse construction is also possible, whereby it is the rotor 9*b* that has one or more projections able to engage in an associated notch provided on the face facing the cylindrical wall 11.

Obviously, any other means that will allow the central part 3 to be secured to the rotor 9*b* in terms of rotation may be anticipated.

Advantageously, such a means for securing in terms of rotation is provided on the cylindrical wall 11 of the central part 3, particularly when the latter is devoid of any frontal wall 15.

Moreover, the central part 3 needs to be attached to the rotor 9*b* in such a way as to be axially blocked. The attachment means for that purpose comprise means of axially blocking the central part 3.

In particular, when the central part 3 is devoid of any frontal wall 15, the issue is one of axially blocking the cylindrical wall 11 with respect to the rotor 9*b* of the motor 9.

Screwing means 29 may be provided for axial blocking (cf. FIG. 6*a*). By way of example, screws are distributed at an even angular spacing, for example three screws 120° apart.

These screwing means 29 may be provided on the frontal wall 15 of the central part 3 when, as in the example of FIG. 2, there is one.

If there is no frontal wall 15, as depicted schematically in FIGS. 6*a*, 6*b*, the screwing means 29 are arranged on the cylindrical wall 11.

For that, the cylindrical wall 11 has at least one radial projection 31 directed toward the rotor 9*b* and configured to bear against the frontal wall 10 of the rotor 9*b* in order to define a screwing surface.

In addition or as an alternative, the axial-blocking means may comprise one or more clipping means 33 (cf. FIGS. 7*a*, 7*b*).

The singular or plural clipping means 33 are, for example, borne by the cylindrical wall 11.

According to the example illustrated in FIGS. 7*a*, 7*b*, the cylindrical wall 11 comprises a clipping means 33 having an elastically deformable clipping tab 35 and a protuberance 37 able to come to bear against the rotor 9*b*.

FIG. 7*b* shows a side view of such a clipping means 33. In this FIG. 7*b*, the start of the blades 5 on the wall 11 is depicted in dotted line.

When the cylindrical wall 11 is assembled with the rotor 9*b*, the protuberance 37 is pressed against the rotor 9*b* and the clipping tab 35 is pushed back outward. At the end of assembly, when the protuberance 37 comes level with the frontal surface 10 of the rotor 9*b*, it extends beyond and positions itself pressing against this frontal surface 10. The clipping tab 35 repositions itself straight against the rotor 9*b*.

Of course, the clip-fastening may be supplemented by a screw fastening.

Quite obviously, any other suitable means that allows the central part 3 of the blower wheel 1 to be blocked axially with respect to the rotor 9*b* may be anticipated.

Thus, a blower wheel 1 having a central part 3 with a frontal wall 15 that is open as defined hereinabove, or even with no frontal wall 15, makes it possible to reduce the amount of material, generally plastic, needed to define the housing for the motor 9, while at the same time guaranteeing rotational drive by the rotor 9*b* and axial blocking of the central part 3 with respect to the rotor 9*b*.

The invention claimed is:

1. A ventilation system comprising a blower wheel (1) and a drive motor (9) with an external rotor (9*b*) having a cylindrical wall and a frontal wall (10), the blower wheel (1) comprising a central part (3) having opposed axial ends and a cylindrical wall (11) extending axially between the axial ends and defining a housing (13) to house the external rotor (9*b*), wherein the central part (3) of the blower wheel (1) further comprises an opening (17) at one of the axial ends so that the central part (3) is devoid of any frontal wall (15), the frontal wall (10) of the external rotor (9*b*) disposed adjacent the opening (17) of the central part (3) such that the opening (17) and the frontal wall (10) of the external rotor (9*b*) are on the same one of the axial ends, and the blower wheel (1) further comprises means of attaching the central part (3) to the external rotor (9*b*), the attachment means being borne by the cylindrical wall (11) and configured to collaborate with complementary attachment means provided on the cylindrical wall of the external rotor (9*b*).

2. The ventilation system as claimed in claim 1, wherein the opening (17) is a circular central opening.

3. The ventilation system as claimed in claim 1, wherein the attachment means comprise means of securing the central part (3) to the rotor (9*b*) in terms of rotation.

4. The ventilation system as claimed in claim 3, wherein the means of securing in terms of rotation comprise at least one of the following means: a rib (19) and complementary groove (21), and a notch (25) and complementary projection (23).

5. The ventilation system as claimed in claim 1, wherein the attachment means comprise means of axially blocking the central part (3).

6. The ventilation system as claimed in claim 5, wherein the axial-blocking means comprise at least one of the following means: screwing means (29), and clipping means (33).

7. The ventilation system as claimed in claim 6, wherein the cylindrical wall (11) has at least one radial projection (31) configured to bear against a frontal wall (10) of the rotor (9*b*) so as to define a screwing surface.

8. The ventilation system as claimed in claim 6, wherein the cylindrical wall (11) bears at least one clipping means (33) comprising an elastically deformable clipping tab (35) and a protuberance (37) able to come to bear against a frontal wall (10) of the rotor (9*b*).

* * * * *